US010337214B2

(12) United States Patent
Topfer et al.

(10) Patent No.: US 10,337,214 B2
(45) Date of Patent: Jul. 2, 2019

(54) ACTIVATION DEVICE FOR A MOTOR VEHICLE LOCK

(71) Applicant: Kiekert Aktiengesellschaft, Heiligenhaus (DE)

(72) Inventors: Claus Topfer, Sindelfingen (DE); Tim Sonnenschein, Velbert (DE)

(73) Assignee: Kiekert AG, Heiligenhaus (DE)

( * ) Notice: Subject to any disclaimer, the term of this patent is extended or adjusted under 35 U.S.C. 154(b) by 407 days.

(21) Appl. No.: 15/129,264

(22) PCT Filed: Mar. 26, 2015

(86) PCT No.: PCT/DE2015/000159

§ 371 (c)(1),
(2) Date: Sep. 26, 2016

(87) PCT Pub. No.: WO2015/149744

PCT Pub. Date: Oct. 8, 2015

(65) Prior Publication Data

US 2017/0114574 A1 Apr. 27, 2017

(30) Foreign Application Priority Data

Mar. 31, 2014 (DE) ..... 10 2014 004 552

(51) Int. Cl.
*E05B 77/06* (2014.01)
*E05B 77/36* (2014.01)
*E05B 77/38* (2014.01)

(52) U.S. Cl.
CPC ..... *E05B 77/06* (2013.01); *E05B 77/36* (2013.01); *E05B 77/38* (2013.01)

(58) Field of Classification Search
CPC ..... Y10T 292/108; Y10T 70/5889; Y10T 292/0932; Y10T 292/1048; Y10T 292/1076; Y10S 292/23; Y10S 292/22
See application file for complete search history.

(56) References Cited

U.S. PATENT DOCUMENTS 6,419,286 B1 * 7/2002 Szablewski ..... E05B 77/24 292/216
2004/0094971 A1 * 5/2004 Warmke ..... E05B 81/06 292/201

(Continued)

FOREIGN PATENT DOCUMENTS

DE 10 2012 110189 A1 6/2013
DE 20 2012 007312 U1 11/2013

(Continued)

OTHER PUBLICATIONS

International Search Report and Written Opinion for corresponding Patent Application No. PCT/DE2015/000159 dated Sep. 21, 2015.

*Primary Examiner* — Mark A Williams
(74) *Attorney, Agent, or Firm* — Renner, Otto, Boisselle & Sklar, LLP

(57) ABSTRACT

The invention relates to an activation device for a door or flap of a motor vehicle, comprising an external actuation lever (1), an actuation lever (10) for opening a lock, and a coupling lever (13) enabling the external actuation lever (1) and actuation lever (10) to be coupled together, and a control lever (10) which controls the coupling of the coupling lever (13) in accordance with the acceleration of the external actuation lever (1). An undesired opening of a door or flap can be prevented in the event of a crash, without the actuation device accepting excessive stresses.

13 Claims, 4 Drawing Sheets

(56) References Cited

U.S. PATENT DOCUMENTS

Figure 1:
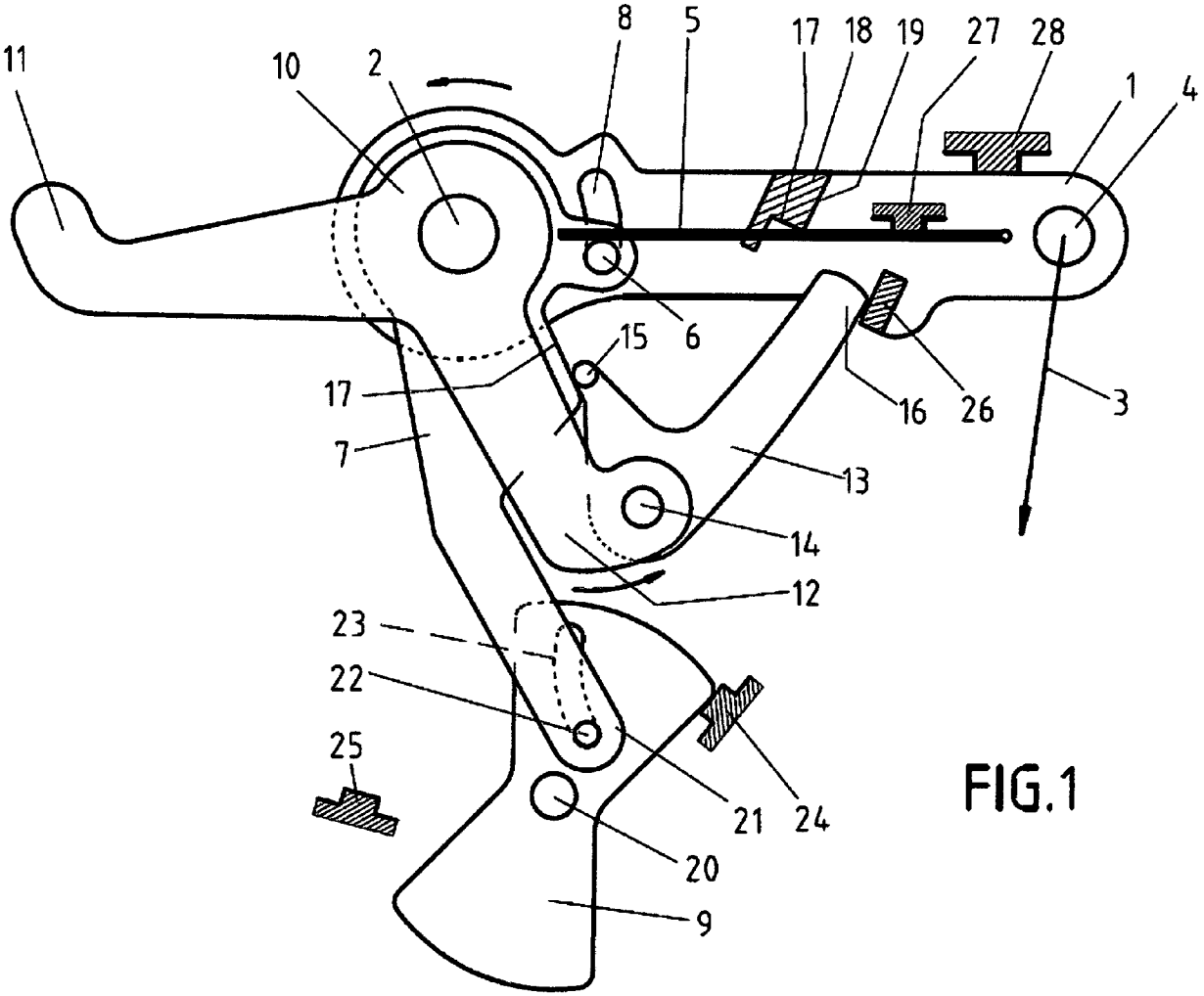

| | | | | |
|---|---|---|---|---|
| 2012/0274084 | A1* | 11/2012 | Rosales | E05B 15/04 292/196 |
| 2013/0147211 | A1* | 6/2013 | Lee | E05B 77/06 292/198 |
| 2014/0203572 | A1* | 7/2014 | Barmscheidt | E05B 77/28 292/200 |
| 2016/0090758 | A1* | 3/2016 | Bendel | E05B 77/06 292/200 |

FOREIGN PATENT DOCUMENTS

| | | | |
|---|---|---|---|
| EP | 1 518 983 | A2 | 3/2005 |
| EP | 2 201 202 | A1 | 6/2010 |
| FR | 2 882 386 | A1 | 8/2006 |
| GB | 1 324 131 | A | 7/1973 |
| WO | WO 2009/034035 | A1 | 3/2009 |
| WO | WO 2012/013182 | A2 | 2/2012 |

* cited by examiner

ACTIVATION DEVICE FOR A MOTOR VEHICLE LOCK

The invention relates to an activation device for a latch of a door or flap of a motor vehicle. Such a latch has a locking mechanism comprising a catch and a pawl for latching of the catch in a ratchet position and optionally a blocking lever for blocking of the pawl in its ratchet position. The purpose of the activation device is to open the door or flap and it enables unlocking of the locking mechanism. By means of activation of the activation device the pawl is moved out of its ratchet position and, if necessary, a blocking lever is moved out of its blocking position and the locking mechanism is finally opened. The door or flap can subsequently be opened.

The activation device usually has a triggering lever which is operated in order to open or unlock the locking mechanism. Such a triggering lever is typically directly or indirectly connected to a door or flap handle. This can be an external or internal handle of a relevant door or flap. If such a handle is operated, the triggering lever is operated or pivoted to unlock the locking mechanism and thus to open the latch.

In the event of an accident or a vehicle collision, also known as a crash hereafter, very high accelerations usually occur suddenly which can be a multiple of gravitational acceleration. Thus the relevant latch, including the lever systems, such as the activation lever, are exposed to considerable forces which can lead to an unwanted opening of the locking mechanism and consequently an opening of the pertaining latch. In the case of a crash, the activation lever, i.e. an internal or external door handle, can also be unintentionally operated which would also lead to an opening of the locking mechanism.

Considerable risks result for the vehicle users due to the described scenarios. Because an unintentionally opened motor vehicle door, for example, can no longer provide the safety devices present in it, such as a lateral airbag or lateral impact protection, for the protection of the vehicle occupants. Thus, mechanisms are provided for with so-called mass inertia locks in order to prevent opening of a door or a flap when excessively high acceleration forces occur, as is the case in a crash.

Such a mechanism has a movable inert mass which needs to be moved for the opening of a door or a flap. If this movable inert mass is not moved or not moved quickly enough in the case of activation of an external door handle, the mechanism prevents the locking mechanism from opening. A mechanism which is capable of achieving this is known, for example, from the publications EP 1 518 983 A2 or WO 2012/013182 A2.

It is a task of the invention to provide an activation device which is capable of preventing unintentional opening of a door or a flap in a crash and with which damage can be prevented in the event of a crash.

In order to solve the task, an activation device encompasses the characteristics of the first claim. Advantageous designs arise from the sub claims. Insofar as not stated otherwise hereinafter, the activation device can encompass the initially stated characteristics known from the state of the art, individually or in any combination.

In order to solve the task, a motor vehicle door latch for a door or a flap of a motor vehicle is provided comprising an external activation lever, an activation lever for the opening of a locking mechanism and a coupling lever. The external activation lever and the internal activation lever can be coupled by at least one coupling lever. There is a control lever which controls the coupling of the coupling lever dependent on the acceleration of the external activation lever.

In case of excessively high accelerations of the external activation lever, the coupling lever does not couple. In normal activation with usual acceleration of the external activation lever the coupling lever couples with the consequence that the activation lever is pivoted for opening of a locking mechanism and thus of a door latch of a door or a flap. Opening is not prevented by a blockade which could lead to mechanical stresses and according damage in the event of a crash.

A lever arm of the coupling lever advantageously fits closely against a contour of the control lever in order to control it in a technically simple and low-noise manner. The fitting is caused by a technically simple design, in particular by a pre-tensioned spring which tensions the coupling lever in the direction of the control lever.

Pivoting of the control lever as a consequence of the pivoting of the external activation lever is advantageously caused by a spring. The spring can behave like a rigid body in the case of normal accelerations in order to transfer a pivoting movement of the external activation lever onto the control lever. In the case of excessive accelerations, the spring does not behave like a rigid body due to a mass inertia element directly or indirectly acting on the spring. A pivoting movement of the external activation lever is not transferred to the control lever without delay. This different movement behavior is used to suitably control the coupling by the coupling lever.

The spring is preferably a leaf spring as this is very easy to manufacture from a technical perspective and a spring constant is very accurately assignable.

The spring is preferably attached to the external activation lever and in particular adjacent to an attachment facility for a Bowden cable, a rope or a rod. A spring can be suitably attached with little installation space.

There is preferably a stop for the spring which is preferably attached to the external activation lever. At a low cost, the spring can thus be suitably installed with the desired force effect.

The coupling lever is preferably pivotably attached to a lever arm of the triggering or activation lever which simplifies coupling and requires little installation space.

The external activation lever preferably has a towing arm which the coupling lever is capable of coupling into for reliable and suitable coupling.

The external activation lever preferably has a lengthwise hole into which a control lever bolt reaches. Relative movements between the external activation lever and the control lever can thus be suitably limited for reliable functioning of the activation device.

The control lever preferably has a stepped contour in order to be able to both control and to prevent excessively high material costs.

The control lever is preferably connected to a component of the inert mass which can be moved dependent on accelerations of the external activation lever in order to prevent, in case of excessively high accelerations, the coupling lever from coupling the external activation lever with the activation lever.

The activation device acts as part of the latching device of a motor vehicle, in particular a lateral door latch, with a locking mechanism comprising a catch and a pawl for latching of the catch. The locking mechanism can be unlocked with the activation device.

The invention relates in particular to a triggering chain, for example in a lateral door latch of a motor vehicle with an active mass lock. Hereby a coupling part is arranged between an external activation lever and an activation lever. The adjusted activation lever can also be described as a triggering lever. The coupling part is pivotably located on the triggering lever and fits closely against a control lever of the mass inertia moment in a spring-tensioned manner. This enables the coupling lever to engage with the external activation lever hereby in a movement of the control lever. However, this simultaneously also means that the coupling lever only engages with the external activation lever during a movement of the control lever, in contrast the coupling part does not engage with the external activation lever when the control lever of the mass inertia element remains. Consequently, the latch cannot be opened. In this case, the coupling part is ineffective and the locking mechanism cannot be unlocked.

In a further design form of the invention, the inert mass is preferably directly formed on the rotational axis of the external activation lever as a ring-shaped element. The ring-shaped element preferably simultaneously acts as a control lever. Hereby the coupling lever also fits closely against a control contour of the ring-shaped mass inertia element. The control contour can be formed by a ring recess.

In one design, the triggering chain of the activation device can simultaneously be used as a central locking element. An extension is formed on the coupling part, for example, which in turn for example works with a bar which prevents engagement of the coupling part in the towing arm of the external activation lever or enables release of the coupling part. Consequently, an engagement of the coupling part becomes definable. If central locking needs to occur, the coupling part is prevented from engaging into the coupling position by an electrical drive. An electrical drive is therefore advantageously present which is capable of controlling the coupling in order to bolt and to additionally use the coupling lever.

The invention is explained in further detail hereinafter in addition to other advantages and designs on the basis of two execution examples.

Figure 2:
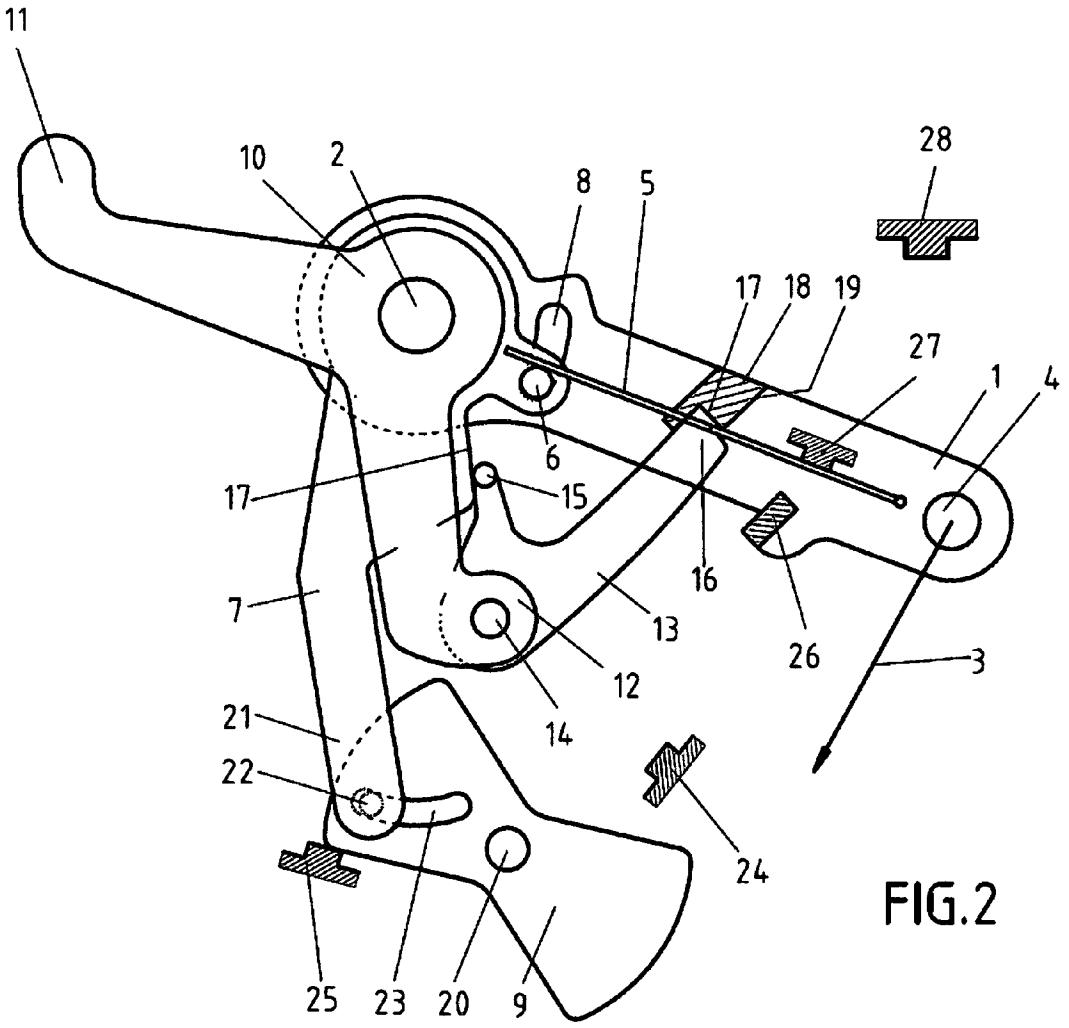
Figure 3:
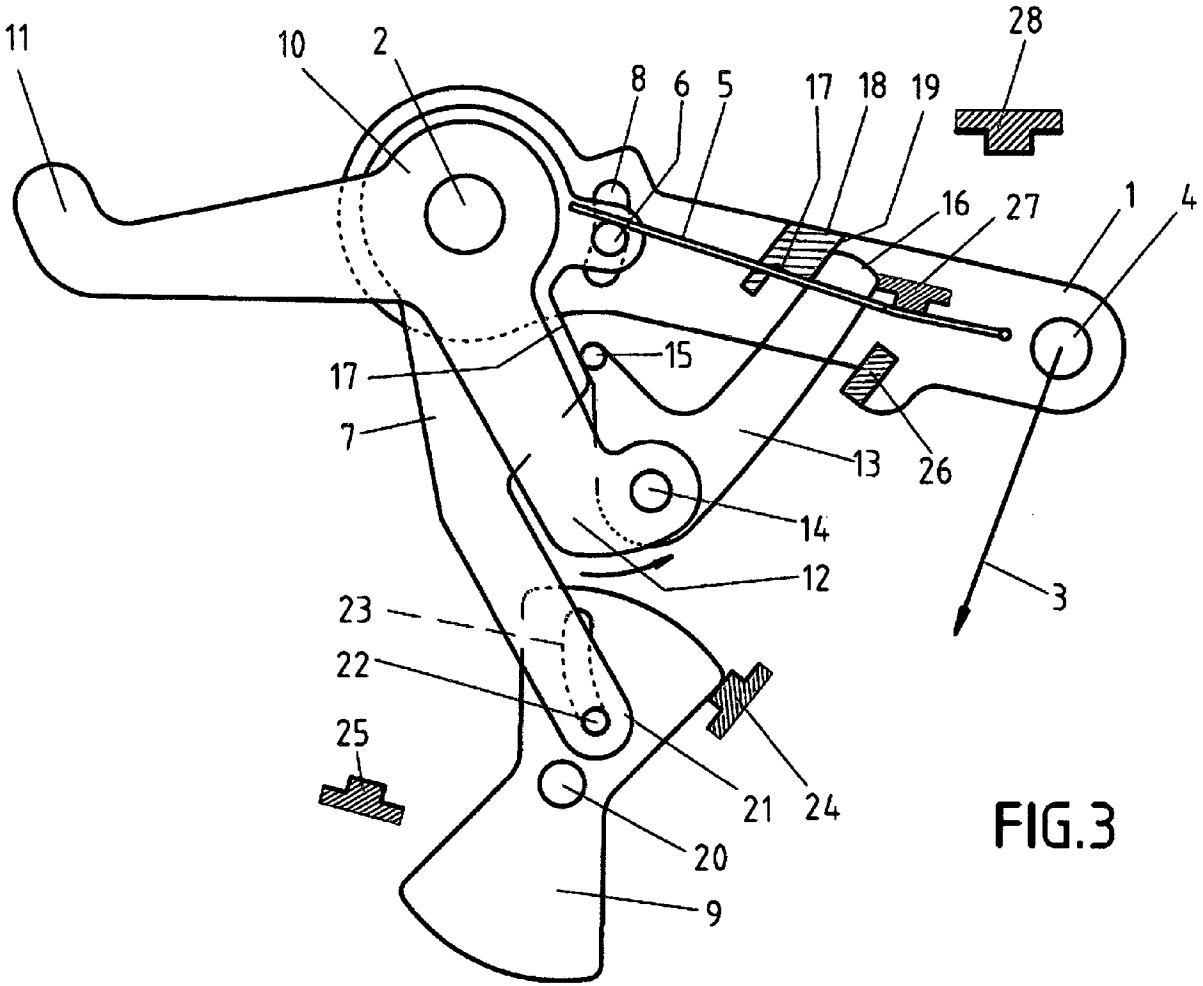
Figure 4:
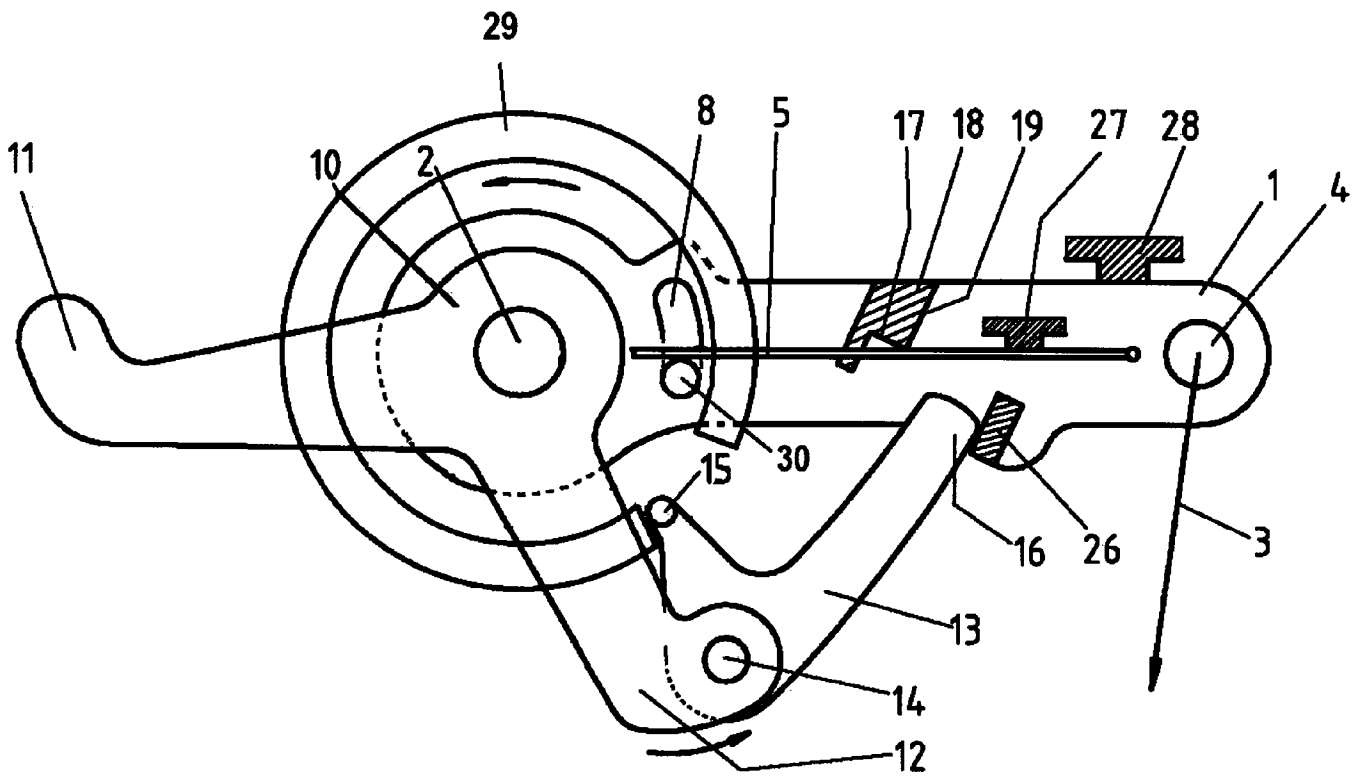

The following are shown:

FIG. 1: mechanism of an activation device in the starting position;

FIG. 2: activated mechanism;

FIG. 3: mechanism following great acceleration;

FIG. 4: mechanism of an activation device with ring-shaped control lever in the starting position.

FIG. 1 shows a mechanism of an activation device for unlocking or opening of a non-illustrated locking mechanism, namely in a starting position in which the activation device is not activated. The mechanism encompasses an external activation lever 1 which is pivotably attached by an axis 2 to a non-illustrated plate or latch plate or a housing of the activation device. The plate or the housing can at the same time be part of a connected, non-illustrated latch, which encompasses a locking mechanism.

The external activation lever 1 is connected via a Bowden cable 3, a rope or a rod with a non-illustrated external door handle. The free end of the external activation lever 1 has an attachment facility 4 for the rope, rod or Bowden cable 3. If the handle is operated, the external activation lever 1 is pivoted around the axis 2 in a clockwise direction with the aid of the rope, the rod or the Bowden cable 3.

One end of a leaf spring 5 is attached to the external activation lever 1 adjacent to the attachment facility 4. The leaf spring 5 extends in the direction of the axis 2 of the external activation lever and ends adjacent to a bolt 6. The spring 5 fits closely against the bolt 6. The bolt 6 is attached to a pivotable control lever 7 which is also pivotably located by the mentioned axis 2. The control lever 7 is part of the inert mass as this needs to be moved in order to open a door or flap and it is not suitably moved in the case of excessively high accelerations. In this design, the control lever 7 is located above the external activation lever 1. The bolt 6 extends both upwards and downwards and upwards in such a way that the bolt 6 is located adjacent to the free end of the leaf spring 5. The bolt 6 extends downwards into a lengthwise hole 8 of the external activation lever. In the rotational direction of the external activation lever 1, i.e. viewed in a clockwise direction, the bolt 6 is arranged behind the leaf spring 5 and is adjacent to a relevant end of the lengthwise hole 8 in the starting position. This end of the lengthwise hole 8 thus limits a pivoting movement of the control lever 7 in a clockwise direction and namely relatively to the external activation lever 1. The lengthwise hole can also limit the rotational movement of the control lever 7 in an anti-clockwise direction relative to the external activation lever 1.

If the external activation lever 1 is accelerated with usual acceleration, the leaf spring 5 behaves as a rigid body. The free end of the leaf spring 5 then conducts a force into the bolt 6 and rotates it and thus also the control lever 7 in a clockwise direction around the axis 2. If the external activation lever is accelerated with high acceleration, the leaf spring 5 does not behave like a rigid body. This is because the spring force of the leaf spring 5 is not sufficient to accelerate the control lever 7 and a connected further component 9 of the inert mass quickly enough.

An activation or triggering lever 10 is pivotably located above the control lever 7 by the axis 2. The activation lever 10 encompasses a lever arm 11, with which a non-illustrated pawl or a non-illustrated blocking lever of the locking mechanism can be moved out of its ratchet or blocking position by pivoting of the lever arm 11 in a clockwise direction in order to thus open, i.e. unlock, the locking mechanism. However, this pivoting of the lever arm 11 in a clockwise direction is only possible if the control lever 7 is also pivoted in a clockwise direction by activation of the activation device, as explained hereinafter.

The activation lever 10 encompasses another lever arm 12. Beneath the free end of the lever arm 12 a coupling lever 13 is pivotably attached to this free end by an axis 14. By means of a non-illustrated spring, the coupling lever 13 is pre-tensioned in such a way in respect of the further lever arm 12 of the activation lever 10 that this spring is capable of moving the coupling lever 13 in an anti-clockwise direction, namely around the axis 14. However, such a rotation in an anti-clockwise direction is prevented in the starting position illustrated in the FIG. 1 because the free end 15 of a lever arm of the coupling lever 13 fits closely against a lateral contour 17 of the control lever 7. The free end 15 can encompass a vertically protruding bolt which is capable of fitting closely against the contour 17. The stepped course of the lateral contour shown in FIG. 1 starting from the area 17 in the direction of the end with the bolt 22 promotes the desired movement process described below and reduces the use of mass and thus weight.

A pivoting of the control lever 7 in a clockwise direction enables a rotational movement of the coupling lever 13 around the axis 14 in an anti-clockwise direction. If the coupling lever 13 is pivoted by the non-illustrated spring in an anti-clockwise direction, a free end 16 of a further lever arm of the coupling lever 13 engages into a stepped recess 17 of a towing arm 18, as can be seen in FIG. 2. The towing arm 18 with the stepped recess 17 is attached on the external activation lever. If the lever arm end 16 of the coupling lever 13 has been moved into this stepped recess 17, the consequence of pivoting the external activation lever 1 in a clockwise direction is that the activation lever 10 is then also pivoted in a clockwise direction. Activation of the handle at normal acceleration therefore pivots the external activation lever 1 in a clockwise direction. This rotational movement of the external activation lever 1 in a clockwise direction is transferred via the leaf spring 5 acting as rigid body on the control lever 7 which is then also pivoted in a clockwise direction around the common axis 2. The pivoting of the control lever 7 in a clockwise direction releases the lever arm end 15 of the coupling lever 13 and thus enables pivoting of the coupling lever 13 around its axis 14 in an anti-clockwise direction. By means of this rotational movement of the coupling lever 13 the free end 16 of a lever arm of the coupling lever enters the step 17 of the towing arm 18. If the free end 16 is located in the step 17 of the towing arm 18, the rotating movement is transferred via the coupling lever 13 onto the activation lever 10 and thus the free end 11 of a lever arm of the activation lever is pivoted for an opening of the locking mechanism in the clockwise direction, as shown in FIG. 2.

If the external activation lever 1 is accelerated and pivoted excessively quickly, the leaf spring 5 does not behave like a rigid body due to the inertia of the control lever 7 and the component 9 of the inert mass. The control lever 7 cannot be pivoted or cannot be pivoted quickly enough around its axis 2 in a clockwise direction. The consequence of this is that the coupling lever 13 is also not pivoted around its axis 14 in an anti-clockwise direction and thus does not enter the stepped recess 17 of the towing arm 18. Instead, the free end 16 of one lever arm of the coupling lever 13 is moved past the step 17 and moves adjacent to the lateral contour 19 of the towing arm 18, as shown in FIG. 3. If this happens as shown in FIG. 3, the free end 16 can no longer enter the stepped recess 17. Further pivoting of the external activation lever 1 in a clockwise direction can therefore not cause the activation lever 10 to be also pivoted in a clockwise direction for opening of the locking mechanism. In the case of excessively high acceleration, the locking mechanism will therefore not open.

The component 9 of the inert mass is attached to a plate or housing by an axis 20. It can be the same plate or the same housing to which the axis 2 is attached. The control lever 7 encompasses a free lever arm end 21. A bolt 22 is attached at this free end 21 which engages into an arc-shaped lengthwise hole 23 of the component 9 of the inert mass. In the starting position, the cylindrical bolt 22 is located close to the axis 20.

If the activation device is intentionally accelerated for opening a door or a flap, i.e. not excessively quickly, the control lever 7 is pivoted in a clockwise direction. This pivoting of the control lever 7 in a clockwise direction exerts a force on the external arc-shaped edge of the lengthwise hole 23 of the component 9 of the inert mass. A force is thus conducted into the component 9 of the inert mass. The component 9 of the inert mass thereupon rotates in an anti-clockwise direction. The consequence of this is that the bolt 22 of the control lever 7 changes its position within the lengthwise hole 23 of the component 9 of the inert mass and is moved from one end of the lengthwise hole 23 in the direction of the other end of the lengthwise hole 23. The lever ratios change as a result. The lever ratios change in such a way that the rotational speed of the component 9 decelerates relatively to the rotational speed of the control lever 7 and the rotational speed of the external activation lever and the activation lever 10. The lever ratios change in such a way that only initially a relatively large force needs to be conducted into the component 9 of the inert mass in order to be able to open a pertaining door or flap.

The component 9 of the inert mass is of a rotationally symmetrical construction apart from the lengthwise hole 23 in order to be able to advantageously execute rotational movements in as vibration-free a manner as possible. This inter alia contributes to low-noise opening. In the direction of the axis 20, around which the component 9 of the inert mass can be pivoted, there is a constriction similar to the number '8'. It is hereby attained that the material or the mass of the component 9 of the inert mass increases with increasing distance from the axis 20. This contributes to minimizing of the mass and weight of the component 9 of the inert mass and to providing as high a mass inertia moment as possible on the starting point of the movement for a control lever 7.

The lengthwise hole 23 of the component 9 of the inert mass can simultaneously act to suitably limit pivoting of the component 9. The lengthwise hole 23 is very large in the present form which is only depicted as an example. For a function of the activation device, only a small angular movement of the bolt 6 in the lengthwise hole 23 is necessary. Consequently, the bolt 6 fits after a small movement closely against an upper end of the lengthwise hole 23.

Alternatively or additionally, stops 24 and 25 can be provided for which suitably limit the pivoting movements of the component 9. The activation device can include further stops which ensure the proper position and location of components. The external activation lever 1 can thus have a stop 26 which limits a pivoting movement of the coupling lever 13 in a clockwise direction. Hereby, inter alia, the location of the activation lever 11 can be fixed in the starting position. A stop 27 can be provided for the leaf spring 5 in order to stabilize the leaf springs 5. A stop 28 can be provided for the external activation lever 1 which limits a pivoting movement into the starting position, i.e. a pivoting movement in an anti-clockwise direction. Stops are advantageously designed as damping elements which therefore have a yielding, for example, an elastomer surface to attenuate noises.

In the figures the component 9 of the inert mass is reproduced in the form of a flattened '8' which is adjacent to a damping element in the rest state as depicted in FIG. 1. The inert mass of the component 9 hereby interacts with the control lever 7 which can be operated via the external activation lever 1 in turn. The principle can also be transferred to other mass locks.

It is of particular importance that the application point of the control lever 7 changes on the component 9 of the inert mass during activation of the control lever 7. The control lever 7 engages into a contour of the component 9 of the inert mass, whereby the application point is initially arranged close to the rotational point, or the rotational axis 20 of the component 9. Hereby, favorable lever ratios and a high mass inertia moment result that is opposed to the triggering chain external activation lever 1, coupling lever 13, activation lever 10. Once deflected, the engagement ratios change between the component 9 of the inert mass and the control lever 7. Consequently, only especially small forces are necessary to move the inert mass of the component 9. An exemplary location of the inert mass of the component 9 is shown in a location pivoted around approx. 90° in FIGS. 1 and 2. In contrast to the location of the component 9 depicted as an example in FIG. 3 the component 9 can also reach the position depicted in FIG. 2. In this position the component 9 can be held in the deflected position via a non-illustrated fixing device. If the component 9 is deflected and fixed, the control lever 7 can thus not reach its starting position shown in FIG. 1 again. Thus, the coupling lever 13 remains in its coupled position, whereby an opening of the locking mechanism by bouncing is also prevented. The coupling lever 13 remains uncoupled as the external activation lever 1 cannot be moved back into its starting position. The external activation lever 1 is prevented from moving back by the close fit of the bolt 6 against the end of the lengthwise hole 8.

Levers can be moved back into starting positions if necessary by one or several non-illustrated springs, for example, the control lever 7 and/or the activation lever 10.

The component 9 of the inert mass can also be dispensed with if the control lever 7 has a sufficient inert mass.

The control lever can also be formed differently and can thus, for example, have the ring shape 29 shown in FIG. 4 to which a bolt 30 is attached or formed. The bolt 30 fits closely against the leaf spring. The ring-shaped mass inertia element 29 is pivotably located on the axis 2. The bolt 30 in turn fits closely against the spring 5 and reaches into a lengthwise hole 8 of the external activation lever 1 in order to thus suitably limit relative movements.

The ring shape can demonstrate a recess as depicted in FIG. 4 in order to enable close fitting of the lever arm end 15 of the coupling lever 13 as depicted. Instead of a recess, a lengthwise hole or a boring can be provided for into which a bolt of the lever arm end 15 of the coupling lever 13 reaches.

The ring form 29 relocates the mass outwards, which is associated with the advantage that a relatively large torque needs to be applied for movement of the ring form, without needing a relatively large weight. Furthermore, the ring form enables saving of installation space compared to the form 17 of the control lever. A further component 9 of the inert mass can then regularly be dispensed with.

REFERENCE SIGN LIST

1: External activation lever
2: Axis for external activation lever
3: Bowden cable
4: Fixing for Bowden cable
5: Leaf spring
6: Bolt of a control lever
7: Control lever
8: Lengthwise hole in the external activation lever
9: Component of an inert mass
10: Triggering or activation lever
11: Lever arm for the activation lever for opening the locking mechanism
12: Lever arm end of the activation lever
13: Coupling lever
14: Axis for coupling lever
15: Lever arm end of the coupling lever
16: Lever arm end of the coupling lever
17: Stepped recess of a towing arm
18: Towing arm for coupling lever
19: External side of the towing arm for coupling lever
20: Axis for component of the inert mass
21: Lever arm of the control lever
22: Bolt of the control lever
23: Lengthwise hole in a component of the inert mass
24: Stop for inert mass
25: Stop for inert mass
26: Stop for coupling lever
27: Stop for spring
28: Stop for external activation lever
29: Ring-shaped control lever
30: Bolt of the ring-shaped control lever

The invention claimed is:

1. An activation device in a motor vehicle door latch for a door or a flap of a motor vehicle, the activation device comprising:

an external activation lever;

an internal activation lever for opening of a locking mechanism;

a coupling lever which is configured to couple the external activation lever and the internal activation lever for opening the locking mechanism;

a control lever which controls coupling of the coupling lever dependent on the acceleration of the external activation lever; and a spring fastened to the external activation lever that pivots the external activation lever, wherein during normal acceleration of the external activation lever, the spring is configured to transfer a pivoting movement of the external activation lever onto the control lever for enabling coupling of the external activation lever and the internal activation lever, and wherein during excessive acceleration of the external activation lever, an inertia of the control lever prevents the spring from transferring the pivoting movement from the external activation lever to the control lever for preventing coupling of the external activation lever and the internal activation lever.

2. The activation device according to claim 1, wherein a lever arm of the coupling lever fits closely against a contour of the control lever.

3. The activation device according to claim 1, wherein the spring is a leaf spring.

4. The activation device according to claim 1, wherein the spring is attached to the external activation lever and is adjacent to an attachment facility for a Bowden cable, a rope or a rod.

5. The activation device according to claim 4, comprising a stop for the spring which is attached to the external activation lever.

6. The activation device according to claim 1, wherein the coupling lever is pivotably attached to a lever arm of the internal activation lever.

7. The activation device according to claim 1, wherein the external activation lever has a towing arm in which the coupling lever is capable of engaging.

8. The activation device according to claim 1, wherein the external activation lever has a lengthwise hole into which a bolt of the control lever reaches.

9. The activation device according to claim 1, wherein the control lever has a stepped contour.

10. The activation device according to claim 1, wherein the control lever is connected to a component, the control lever and the component forming an inert mass which is movable dependent on accelerations of the external activation lever in order to prevent the coupling lever coupling the external activation lever with the internal activation lever with excessively high accelerations.

11. The activation device according to claim 1, wherein an electrical drive is provided for the coupling lever which controls coupling of the coupling lever.

12. The activation device according to claim 1, wherein the control lever has a ring shape.

13. A latching device with a locking mechanism comprising a catch and a pawl for latching of the catch with an activation device according to claim 1 which is configured for unlocking the locking mechanism.

* * * * *